US007775407B2

(12) United States Patent
Dyer

(10) Patent No.: US 7,775,407 B2
(45) Date of Patent: Aug. 17, 2010

(54) CONTENTS EXTRACTOR FOR JARS

(76) Inventor: Joseph L. Dyer, 7323 Shepherd St, Sarasota, FL (US) 34243

( * ) Notice: Subject to any disclaimer, the term of this patent is extended or adjusted under 35 U.S.C. 154(b) by 408 days.

(21) Appl. No.: 12/073,988

(22) Filed: Mar. 12, 2008

(65) Prior Publication Data

US 2009/0230154 A1 Sep. 17, 2009

(51) Int. Cl.
*B67D 7/60* (2010.01)
*B65D 47/02* (2006.01)

(52) U.S. Cl. ..... 222/386; 222/405; 222/342; 222/407; 215/16

(58) Field of Classification Search ..... 222/386, 222/405, 407, 406, 391, 325, 326, 327, 342, 222/340, 341, 336, 191, 322, 323, 392, 343, 222/344, 345, 346, 335, 505, 506, 507, 509; 215/16

See application file for complete search history.

(56) References Cited

U.S. PATENT DOCUMENTS

| | | | | |
|---|---|---|---|---|
| 944,091 | A | 12/1909 | Harn | |
| 2,294,096 | A | 8/1942 | Rice | |
| 2,420,260 | A | 5/1947 | Myszkowski | |
| 2,727,777 | A | 12/1955 | Johnstone et al. | |
| 3,034,687 | A * | 5/1962 | Wiese | 222/256 |
| 3,097,658 | A | 7/1963 | Runco | |
| 4,026,311 | A | 5/1977 | Jackson | |
| 5,104,050 | A | 4/1992 | Herbert | |
| 6,257,459 | B1 * | 7/2001 | Michelson et al. | 222/322 |
| 6,269,974 | B1 * | 8/2001 | Michelson et al. | 222/1 |
| 6,299,030 | B1 * | 10/2001 | Michelson et al. | 222/322 |
| 6,318,602 | B1 * | 11/2001 | Michelson et al. | 222/322 |
| 6,561,388 | B2 * | 5/2003 | Michelson et al. | 222/322 |
| 7,070,070 | B2 * | 7/2006 | Michelson et al. | 222/322 |
| 2005/0133511 | A1 | 6/2005 | Makriyiannis | |
| 2006/0131337 | A1 | 6/2006 | Mertins | |
| 2006/0254431 | A1 | 11/2006 | Mariano | |

* cited by examiner

*Primary Examiner*—Kevin P Shaver
*Assistant Examiner*—Stephanie E Tyler
(74) *Attorney, Agent, or Firm*—Richard C. Litman

(57) ABSTRACT

The contents extractor for jars is a device that is inserted into a food jar or household container. The extractor has a handle with an actuator that the operator squeezes; an elongated mechanized shaft that transmits movement from the actuator; and, a flexible material that retracts and transforms into a 360° disk shape to the inner surfaces of container. When the extractor is inserted into the jar and retracted, the operator pulls the entire device upward out of the container, thus removing the residue remaining. The extractor allows the consumer to use more of the product than would otherwise be possible, thereby saving money for the consumer and reducing resources used to make the product.

3 Claims, 3 Drawing Sheets

CONTENTS EXTRACTOR FOR JARS

BACKGROUND OF THE INVENTION

1. Field of the Invention

The present invention relates to container accessories, and in particular, to a contents extractor for jars that is used to extract the residual contents from the bottom of the jar to make efficient use of the storage space provided by the jar.

2. Description of the Related Art

In the past, the conventional means for storing perishable foods has involved the use of glass, plastic and metal jars and cans that have an inherent oxygen barrier characteristic. One problem with conventional storage means is that when an item that it is being stored in a jar, such as mayonnaise or apple butter, is running low, it makes it difficult to reach the bottom of the jar (whether you are using a spoon or any other device or food such as a chip) and scoop up the contents. This is not an efficient use of the storage space provided by the jar, and can result in messes and spills trying to scoop out the contents. The need for a device that allows an efficient and easy method to reach items from a bottom of a jar shows that there is still room for improvement in the art.

Thus, a contents extractor for jars solving the aforementioned problems is desired.

SUMMARY OF THE INVENTION

The contents extractor for jars is a device that is inserted into a food jar or household container. The extractor has a handle with an actuator that the operator squeezes, an elongated mechanized shaft that transmits movement from the actuator, and a flexible material that retracts and transforms into a 360° disk shape to the inner surfaces of container. When the extractor is inserted into the jar and retracted, the operator pulls the entire device upward out of the container, thus removing the residue remaining. The extractor allows the consumer to use more of the product than would otherwise be possible, thereby saving money for the consumer and reducing resources used to make the product.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
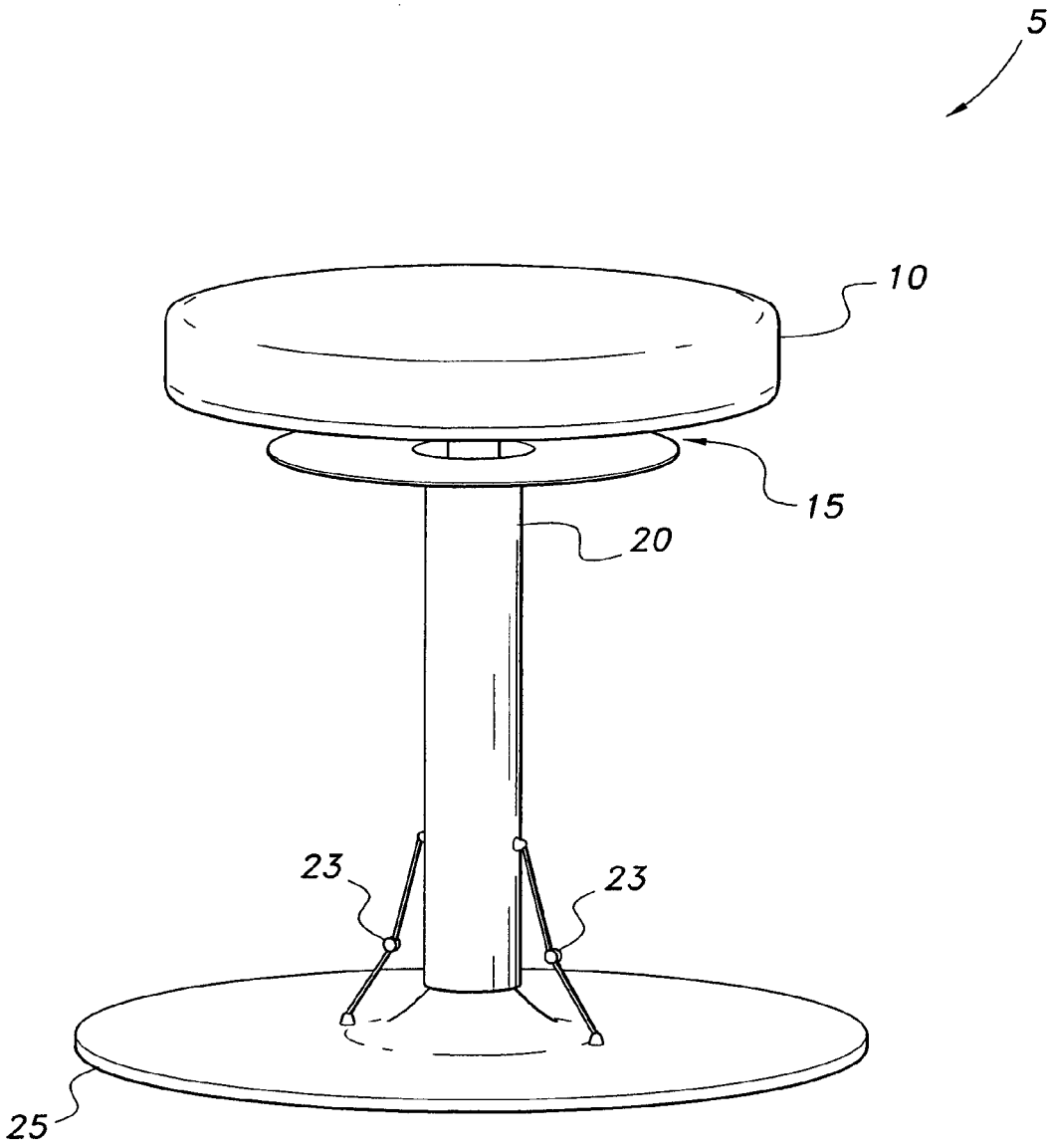
FIG. 1 is a perspective view of a contents extractor for jars according to the present invention.
Figure 2:
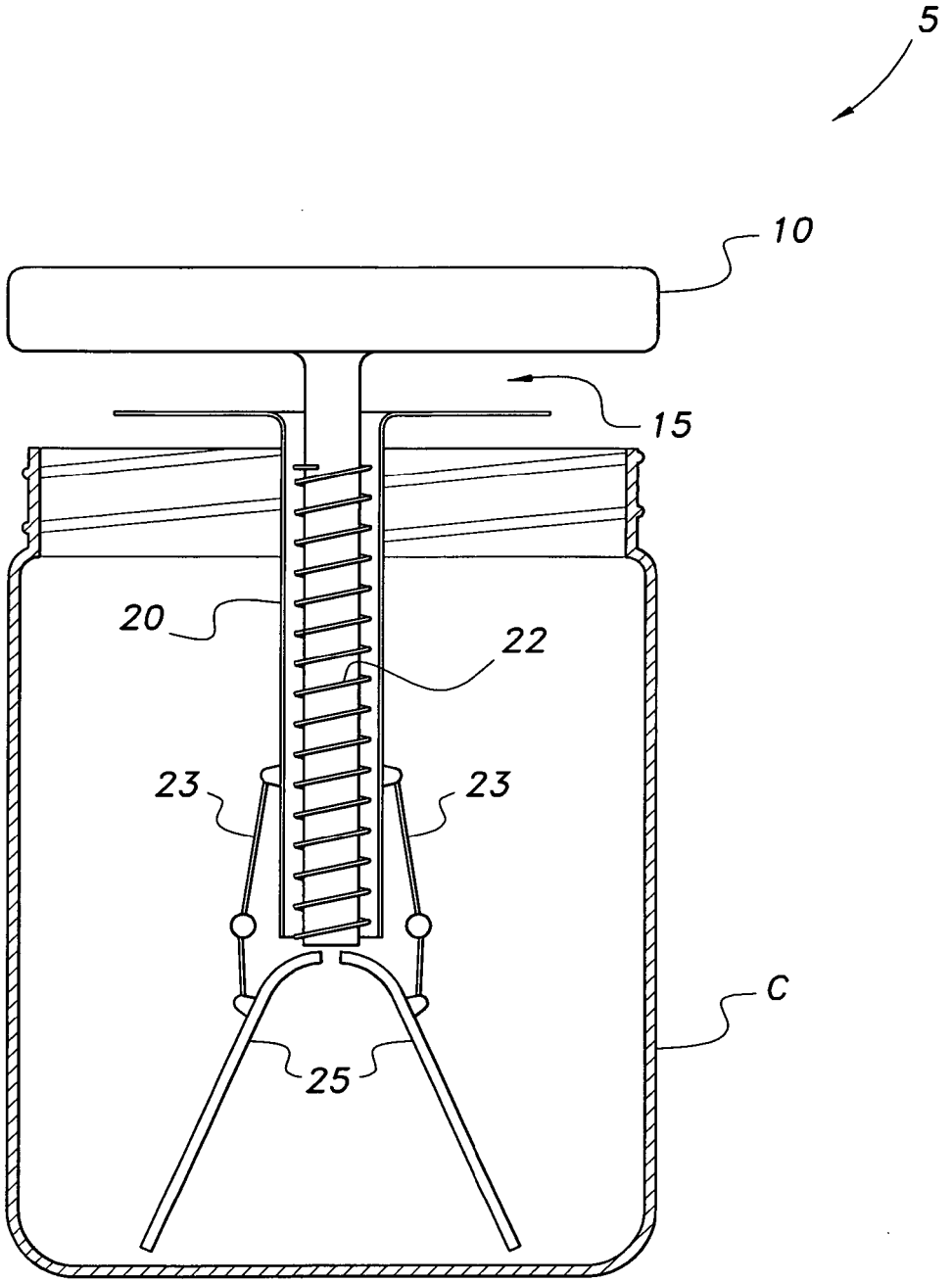
FIG. 2 is a plan view of the contents extractor for jars according to the present invention being inserted into the jar.
Figure 3:
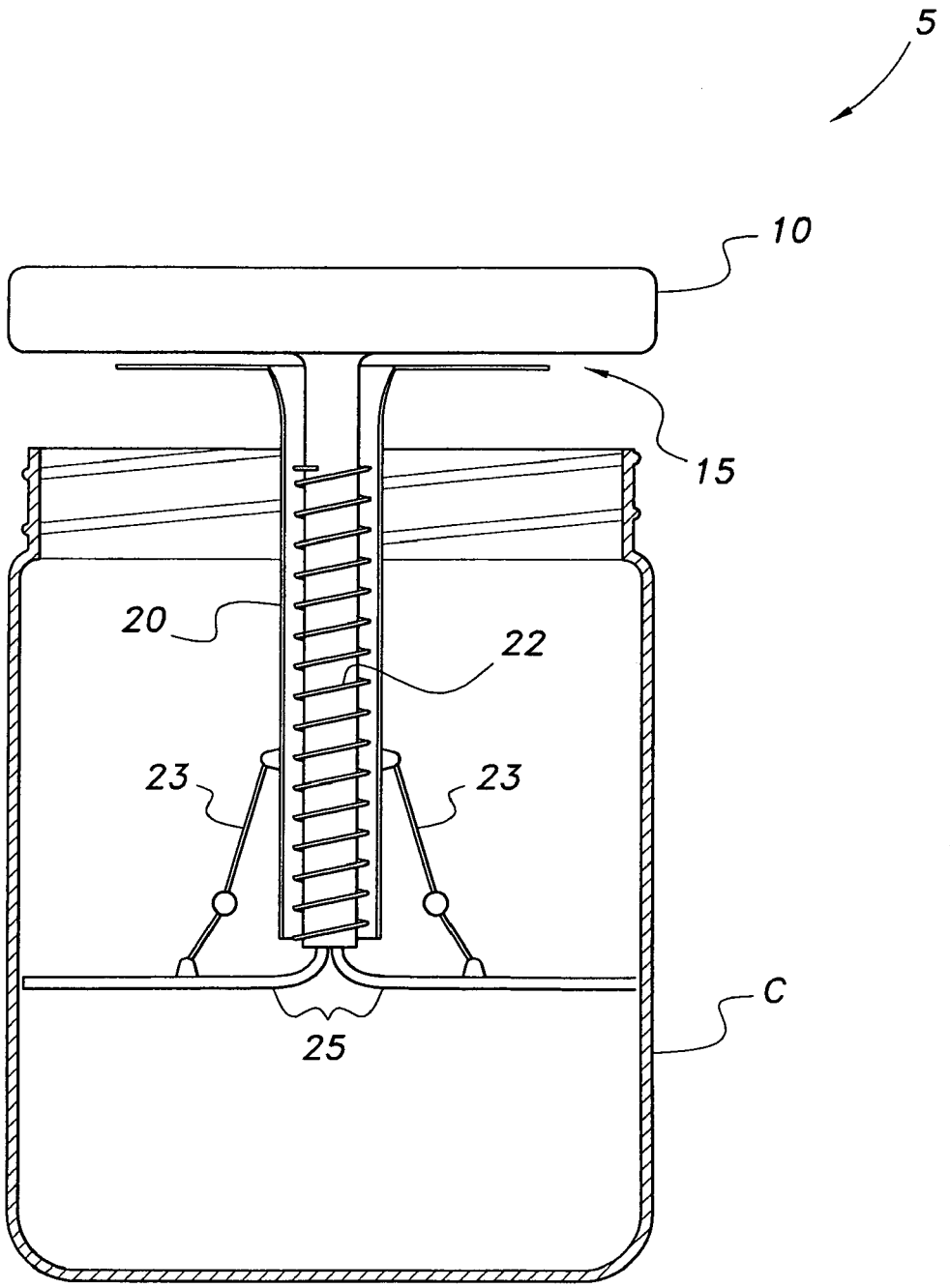
FIG. 3 is a plan view of the contents extractor for jars according to the present invention, shown extended inside the jar and ready to extract the contents.

As shown in FIGS. 1-3, the present invention relates to a contents extractor 5 for jars that is inserted into a food jar or household container C to help remove the contents from the bottom of the jar. The extractor 5 has a handle 10 with an actuator 15 that the operator squeezes. An elongated mechanized shaft 20 transmits movement from the actuator to the bottom of the shaft 20. Movement transmission to the bottom of shaft 20 may be effected via a spring 22, which is coaxially disposed on the shaft and mechanically coupled to the actuator 15. Responsive to the transmitted movement, a disk-shaped flexible material 25 connected to the bottom end of shaft 20 retracts outward via extending pivot arms 23 and extends 360° to the inner surfaces of container C, much like a butterfly valve. When the flexible material 25 is retracted, the operator pulls the entire extractor 5 upward out of the container C, thus removing the residue remaining by scraping the walls of the container C. Although flexing along a diameter of the disc, the flexible material is otherwise rigid enough to lift the contents from the jar. The extractor 5 allows the consumer to use more of the product than would otherwise be possible, thereby saving money for the consumer and reducing resources used to make the product.

It is to be understood that the present invention is not limited to the embodiment described above, but encompasses any and all embodiments within the scope of the following claims.

I claim:

1. A contents extractor for jars, comprising:

a handle having an actuator responsive to a user's grasp;

an elongated mechanized shaft extending from the handle and having a bottom end opposite the handle;

pivot arms extending from the shaft, the pivot arms being operably connected to the actuator; and a flexible material disposed at the bottom end of the shaft, the flexible material being connected to the pivot arms, the flexible material being pivotal between a folded position and an unfolded position, the flexible material defining a circular disk adapted for scraping the contents of the jar from sidewalls of the jar and lifting the contents therefrom when the flexible material is in the unfolded position.

2. The contents extractor for jars according to claim 1, further comprising a spring coaxially disposed on the shaft, the spring being mechanically coupled to the actuator.

3. The contents extractor for jars according to claim 2, wherein said spring is mechanically coupled to the pivot arms.

* * * * *